US006454541B1

(12) United States Patent
Ijiri et al.

(10) Patent No.: US 6,454,541 B1
(45) Date of Patent: Sep. 24, 2002

(54) METHOD FOR TRANSFERRING EASILY-POLYMERIZABLE SUBSTANCE

(75) Inventors: Yuichi Ijiri; Takeshi Nishimura; Kazuhiko Sakamoto; Hiroo Iwato; Takashi Sera, all of Himeji (JP)

(73) Assignee: Nippon Shokubai Co., Ltd., Osaka-fu (JP)

( * ) Notice: Subject to any disclaimer, the term of this patent is extended or adjusted under 35 U.S.C. 154(b) by 0 days.

(21) Appl. No.: 09/685,582

(22) Filed: Oct. 11, 2000

(30) Foreign Application Priority Data

Oct. 12, 1999 (JP) ..... 11-289324

(51) Int. Cl.[7] ..... F04B 1/00
(52) U.S. Cl. ..... 417/53; 417/429.1; 415/111
(58) Field of Search ..... 415/51.1, 55.1, 415/58.2, 58.4, 111, 112, 175, 176, 180, 417

(56) References Cited

U.S. PATENT DOCUMENTS 3,853,433 A * 12/1974 Roberts et al. ..... 417/423
4,239,422 A * 12/1980 Clancey ..... 415/112
4,990,068 A 2/1991 Zhong et al.
5,397,220 A 3/1995 Akihisa et al.
6,142,748 A * 11/2000 Harris et al. ..... 417/313

FOREIGN PATENT DOCUMENTS

| | | |
|---|---|---|
| DE | 2361272 | 6/1975 |
| DE | 3905419 | 8/1990 |
| JP | 8-73398 | 3/1996 |

* cited by examiner

*Primary Examiner*—Edward K. Look
*Assistant Examiner*—Igor Kershteyn
(74) *Attorney, Agent, or Firm*—Wenderoth, Lind & Ponack, L.L.P.

(57) ABSTRACT

A method for transferring an easily-polymerizable substance by using a vertically-arranged circulation type canned motor pump or a gas seal type motor pump. Transferring the easily-polymerizable substance such as (meth)acrylic acid with use of the motor pump having the vertically-arranged main shaft enables effective prevention of polymerized matter in the pump. The method assures stable transfer of easily-polymerizable matter for a prolonged time.

14 Claims, 3 Drawing Sheets

METHOD FOR TRANSFERRING EASILY-POLYMERIZABLE SUBSTANCE

BACKGROUND OF THE INVENTION

This invention relates to a method for transferring an easily-polymerizable substance, and more particularly to a method for transferring an easily-polymerizable substance such as (meth)acrylic acid in a stable manner for a longer time by effectively preventing polymerization.

In the field of chemical industries, it has been strongly demanded to transfer an easily-polymerizable substance without polymerization in transfer passages. Many studies and trials have been made to satisfy this demand. Some proposed transferring manners and methods could successfully solve some problems. However, there yet remains problems to be solved.

As one of the problems to be solved, there is the problem that polymerization occurs in a pump which provides a moving force to an easily-polymerizable substance. Recently, leak-free pumps are used for transferring an easily-polymerizable substance as well as other liquids to securely preventing leakage of liquid which is harmful to human beings, explosive or flammable, or need careful handling.

A circulation type canned motor pump is one example of such leak-free pumps, and is provided with a circulation tube for circulating a part of liquid being transferred into a motor portion to cool the motor. In conventional circulation type canned motor pumps, a main shaft mounted with a rotor and an impeller is arranged along a horizontal axis, and an impeller of the pump is rotated about the horizontal axis. Circulated cooling liquid is flowed in the horizontal direction. With this construction, it is likely that the cooling liquid comes into sufficient contact with a lower part of bearings for rotatably supporting the rotor shaft, but comes into insufficient contact with an upper part of the bearings. Consequently, polymerization is liable to occur on the upper part of the bearings due to the heat generated by the motor in the case where the liquid being transferred is an easily-polymerizable substance or contains an easily adhesive substance.

With this construction in which the main shaft extends in the horizontal direction, the circulation tube becomes long in the horizontal direction. Accordingly, polymerization is liable to occur in the circulation tube due to the small sectional area and the long horizontal length of the circulation tube.

Polymerization on the bearing or its near portion and in the circulation tube causes obstruction for the circulation of cooling liquid, resulting in an undesirable rise in the temperature of the motor which causes further polymerization.

To overcome these problems, for example, Japanese Unexamined Patent Publication No. 6-272688 proposes polishing bearing contact portions of a rotor shaft of a motor with electrolysis to ensure smooth flow of cooling liquid around the bearings. However, the main shaft extends in the horizontal direction. Accordingly, this conventional canned motor pump can not entirely overcome the above-mentioned problem due to the horizontal shaft construction.

Also, Japanese Unexamined Patent Publication No. 8-73398 is directed to a circulation type canned motor pump for transferring an easily-polymerizable substance under a reduced pressure. In this canned motor pump, a part of circulated cooling liquid is passed through a chamber containing gas having oxygen and having a normal pressure, and then flowed into the motor portion. However, this canned motor pump has the main shaft extending in the horizontal direction, and accordingly can not sufficiently overcome the above-mentioned problem due to the horizontal shaft construction.

Formation of polymerized matter in a transferring pump or clogging or choking in a circulation tube of a circulation type canned pump, nevertheless, cannot be avoided when a chemical process system provided with such transferring pumps is operated for a long time in the aforementioned conventional manner because the material to be transferred is an easily-polymerizable compound such as (meth)acrylic acid. When choking or clogging occurs, it is required to suspend the operation of the system so as to chemically or manually remove the clogged polymerized matter. In a worse case, replacement of the pump is necessary.

SUMMARY OF THE INVENTION

It is an object of the present invention to provide an easily-polymerizable substance transferring method which is free from the problems residing in the prior art.

According to an aspect of the invention, an easily-polymerizable substance is transferred by a pump provided with a motor. A main shaft of the motor is arranged in a vertical direction. The main shaft is mounted with an impeller for imparting a moving force to an easily-polymerizable substance and a rotor constituting a part of the motor. The impeller is arranged in a lower portion while the rotor is arranged in an upper portion.

The arrangement of the main shaft carrying the impeller and rotor in the vertical direction will increase the motor cooling efficiency without causing polymerization, thereby ensuring the prolonged operation of the chemical processing system using an easily-polymerizable compound.

Other objects, features and advantages of the present invention will become apparent from the detailed description of the preferred embodiments of the invention to follow.

DETAILED DESCRIPTION OF THE PREFERRED EMBODIMENTS OF THE INVENTION

The inventors of this invention have studied, using a trial and error technique, a manner to eliminate polymerization of easily-polymerizable substances in undesirable locations of a transfer route, in particular, at transferring motorized pumps, and found that polymerization can be reliably prevented by using a motorized pump whose main shaft extends in a vertical direction.

Specifically, an easily-polymerizable substance may be preferably transferred by using a circulation type canned motor pump whose main shaft extends in a vertical direction. It may be more preferable to mount a circulation tube having a horizontal portion shorter than a vertical portion.

Alternatively, it may be preferable to use a gas seal type motor pump whose main shaft extends in a vertical direction, and which is provided with a gas chamber between an impeller and a motor portion. More preferably, the gas chamber is filled with molecular oxygen-containing gas. It may be more preferable that the chamber is filled with 0.01 to 0.05 volumetric percent of the oxygen-containing gas to the capacity of the pump.

Examples of the easily-polymerizable substance to be transferred according to the inventive method are (meth) acrylic acid and its ester including (meth)acrylates such as hydroxyethy(meth)acrylate, hydroxypropyl(meth)acrylate, glycydyl(meth)acrylate, methyl(meth)acrylate, butyl(meth) acrylate, ethylacrylate, 2-ethylhexylacrylate, N,N-dimethylaminoethylacrylate.

The inventive method may be adapted to transfer such compounds alone or in combination, or a liquid containing such compounds alone or in combination.

The inventive method may be preferably used for the transfer of an easily-polymerizable substance such as (meth) acrylic acid for production, storage, or transportation. In particular, the inventive method may be suitable for transferring or drawing out liquid collected in a lower portion of a distillation tower from the distillation tower since such a liquid has a considerably higher temperature, and is thus liable to cause polymerization.

Next, description will be made about preferred embodiments of the invention with reference to drawings.

Figure 1:
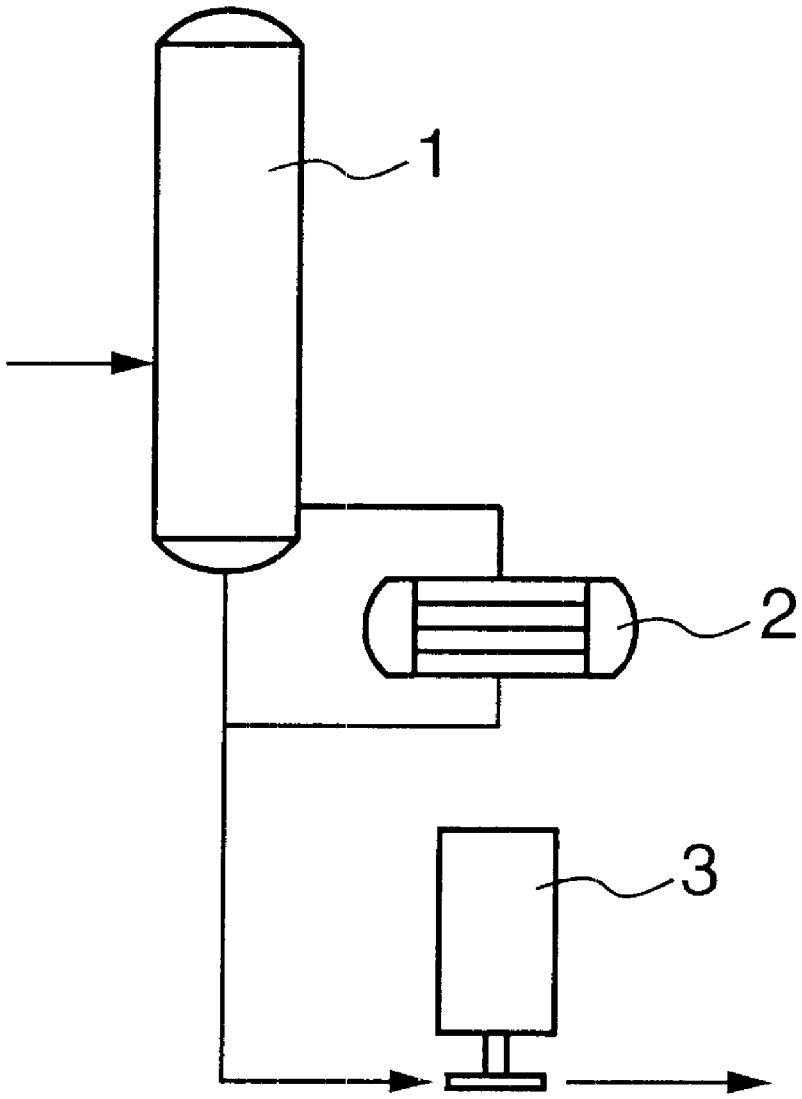
FIG. 1 is a schematic diagram showing a chemical processing system for processing an easily-polymerizable substance according to an embodiment of the invention.

Referring to FIG. 1 showing a chemical processing system for processing an easily-polymerizable substance, a distillation tower 1, a reboiler 2, and a transferring pump 3 having a main shaft extending in a vertical direction and an impeller at a bottom thereof are provided. Material including an easily-polymerizable substance is supplied into the distillation tower 1 provided with the reboiler 2, and then distilled therein. An easily-polymerizable substance in the liquid phase is collected in a lower portion of the tower 1, and is drawn out of the tower 1 to a next processing unit by the transferring pump 3.

Figure 2:
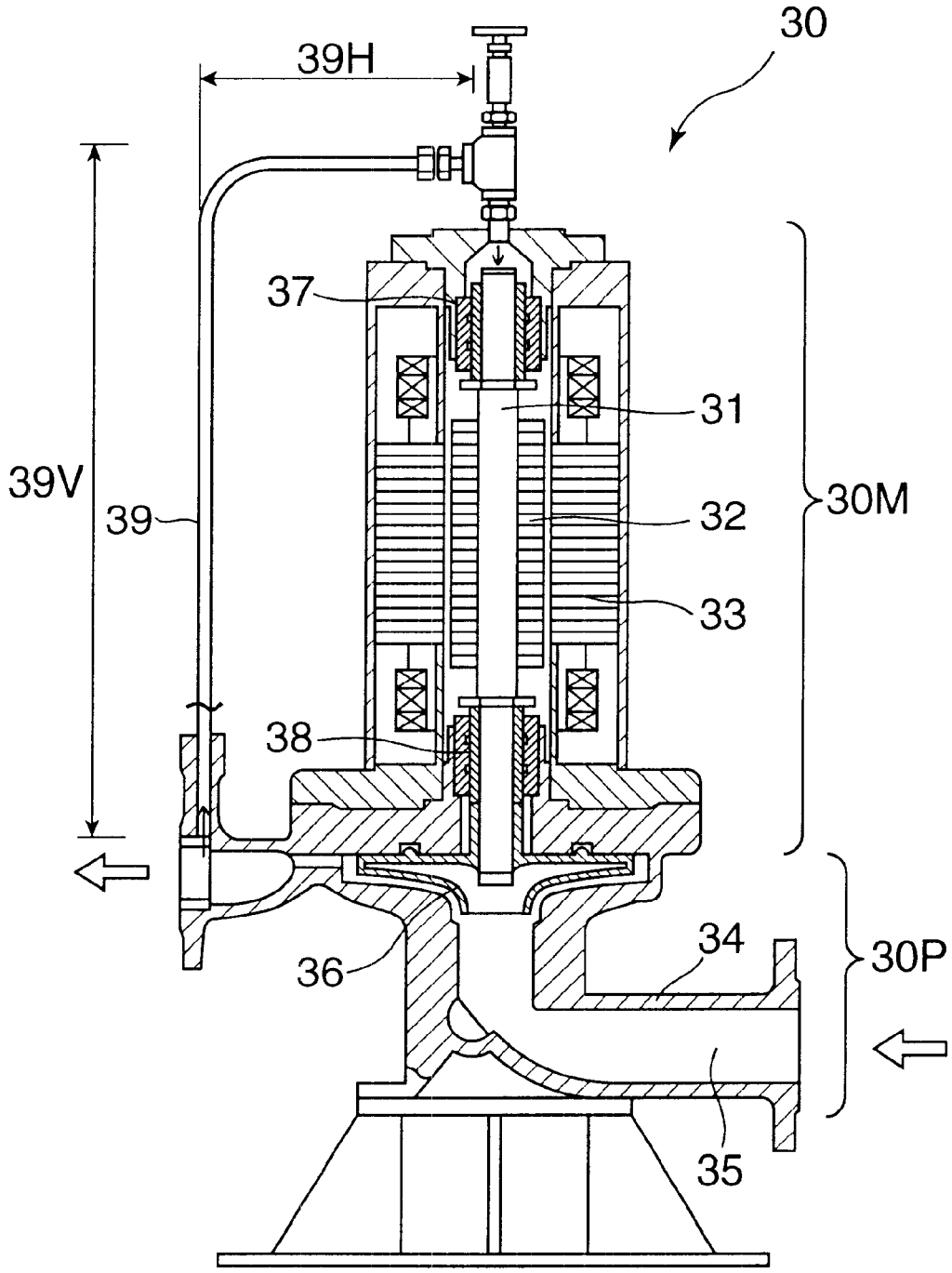
FIG. 2 is a sectional view of a circulation type canned motor pump which is used as a transferring pump of the chemical processing system.

FIG. 2 shows a specific construction of a circulation type canned motor pump 30 used as the transferring pump 3. The circulation type canned motor pump 30 includes a motor section 30M and a pump section 30P arranged below the motor section 30M. The motor section 30M is provided with a main shaft 31 extending in a vertical direction to the pump section 30P, a rotor 32 mounted on an intermediate portion of the main shaft 31, and a stator 33 disposed around the rotor 32. The rotor 32 and the stator 33 constitute a motor. The main shaft 31 mounted with the rotor 32 is rotatably held in the vertical direction by bearings 37 and 38.

The pump section 30P is constructed by a casing 34 defining a main passage 35 through which the easily-polymerizable substance is transferred, and an impeller 36 mounted on a lower end of the main shaft 31. The impeller 36 is rotated by the main shaft 31 to impart a moving force to the easily-polymerizable substance, so that the easily-polymerizable substance flows in the arrow direction.

The motor pump 30 is further provided with a circulation tube 39 for circulating a part of the liquid being transferred into the motor section 30M. Specifically, one end of the circulation tube 39 is connected with the main passage 35 while the other end of the circulation tube 39 is connected to a top end of the motor section 30M. A part of the liquid is circulated or flowed from the main passage 35 to the top of the motor section 30M, and flowed or sprayed inside of the motor section 30M. Subsequently, the liquid flows down along the main shaft 31 through the bearings 37 and 38, and then flows back into the main passage 35. The circulated liquid removes the heat generated around the bearing 37 and 38, and the rotor 32 by the rotation of the main shaft 31, and consequently keeps the motor section 30M below a predetermined temperature.

In the canned motor pump 30, the circulation tube 39 has a horizontal portion 39H and a vertical portion 39V. The horizontal portion 39H is much shorter than the vertical portion 39V, which can eliminate the likelihood that the easily-polymerizable substance being circulated polymerizes in the circulation tube 39 due to the possible slow flow in the horizontal portion 39H.

In the canned motor pump 30, also, the circulated liquid is supplied down from the top of the motor section 30M. Accordingly, the circulated liquid uniformly comes into contact with the main shaft 31, the rotor 32, and the bearings 37 and 38, thereby preventing the partial cooling which is likely to occur in the conventional pump having a horizontally-arranged main shaft. In other words, polymerization in the motor section can be remarkably suppressed.

Figure 3:
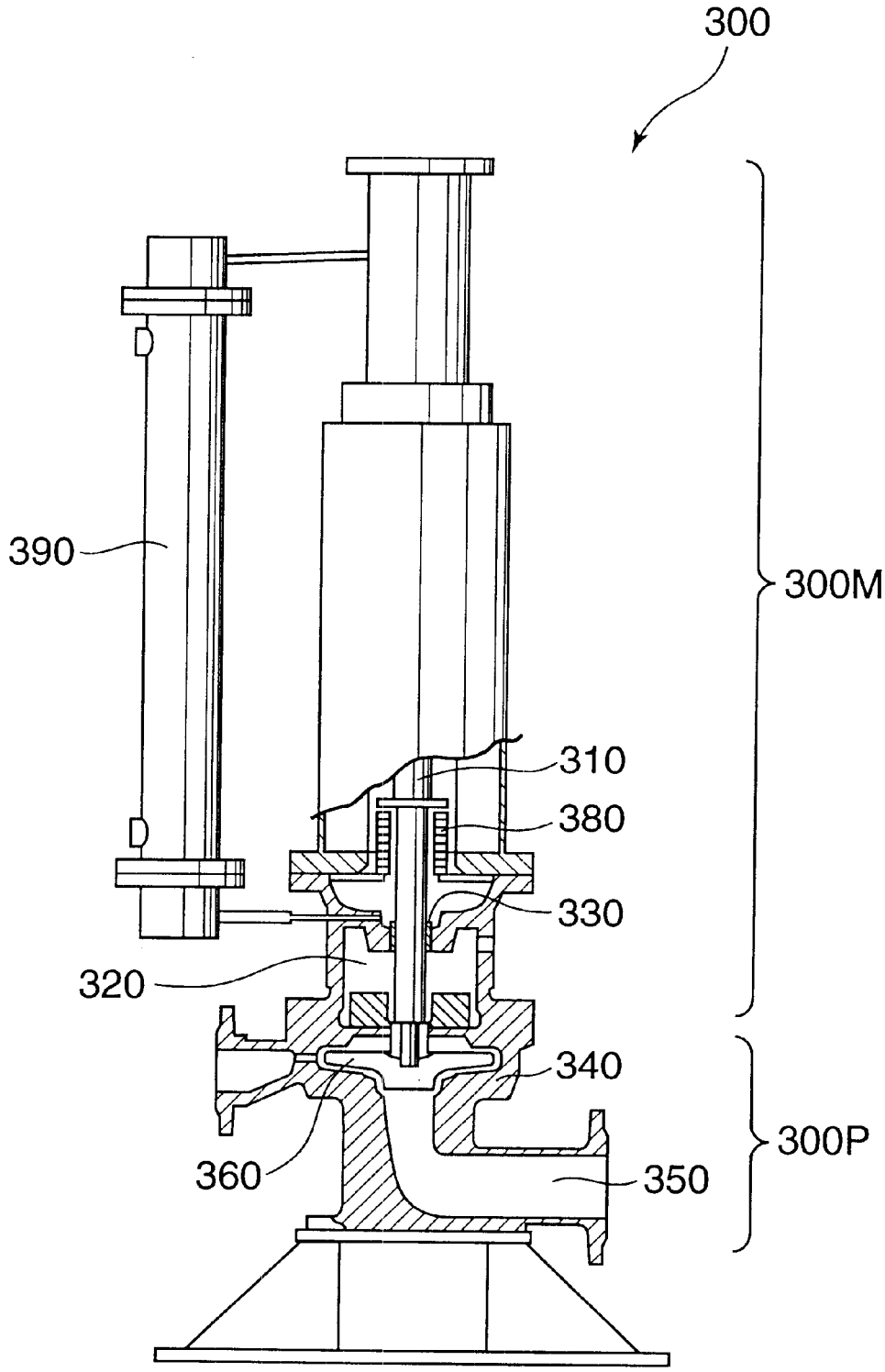
FIG. 3 is a partial section view of a gas seal type pump which is used as an alternative transferring pump of the chemical processing system.

FIG. 3 shows a specific construction of a gas seal type motor pump 300 alternatively used as the transferring pump 3. Similarly to the circulation type canned motor pump 30, the gas seal type motor pump 300 includes a motor section 300M and a pump section 300P arranged below the motor section 300M. The motor section 300M is provided with a main shaft 310 extending in a vertical direction to the pump section 300P. Also, the main shaft 310 is mounted with a rotor (not shown). The main shaft 310 is rotatably held in the vertical direction by bearings 380. The pump section 300P is provided with a casing 340 defining a main passage 350 through which the easily-polymerizable substance is transferred, and an impeller 360 mounted on a lower end of the main shaft 310 for transferring the easily-polymerizable substance.

However, the gas seal type motor pump 300 is not provided with such a circulation tube as is provided in the circulation type canned motor pump 30. In other words, the gas seal type motor pump 300 is not provided with a circulation line to circulate a part of the liquid being transferred by the motor pump 300. In this pump 300, a heat exchanger 390 is connected with the motor section 300M to circulate a particular liquid in a closed loop defined by the motor section 300M and the heat exchanger 390 to keep the motor section 300M below a predetermined temperature. Accordingly, there is no likelihood that polymerization occurs in the motor section 300M.

In the gas seal type motor pump 300, also, there is provided a gas chamber 320 between the motor section 300M and the pump section 300P. The gas chamber 320 is separated from the motor section 300M by a mechanical seal 330. The gas chamber 320 is filled with molecular oxygen-containing gas. It may be preferable to fill 0.01 to 0.05 volumetric percent of the oxygen-containing gas relative to the capacity of the pump 300 within the gas chamber 320.

In the gas seal type motor pump 300, the motor section 300M which is the heat generation source is arranged in the top, the easily-polymerizable substance flowing passage 350 which is required to keep from heat is arranged in the bottom, and the gas chamber 320 which serves as heat isolation is arranged between the motor section 300M and the liquid flowing passage 350. Accordingly, the heat generated in the motor section 300M can be assuredly prevented from transmitting to the liquid flowing passage 350, thereby keeping polymerization from occurring in the liquid flowing passage 350 and around the impeller 360.

Next, description will be made about examples and comparative examples to confirm the advantageous effects of the inventive method.

EXAMPLE 1

Distilled liquid of acrylic acid having the following composition was drawn out from a distillation tower with use of a circulation type canned motor pump which has a vertically-arranged main shaft, and a maximum discharge amount of 10 $m^3$/Hr, a maximum head of 50 m, and a casing made of SUS316, and manufactured by Teikoku Denki Seisakusho Kabushiki Kaisha under the below-mentioned states and condition.

| | |
|---|---|
| Composition: | |
| Acrylic acid | 5 wt. % |
| Acrylic acid dimer | 30 wt. % |
| Maleic acid | 5 wt. % |
| Other impurities | 60 wt. % |
| States: | |
| Liquid temperature | 100° C. |
| Liquid density | 1100 kg/$m^3$ |
| Liquid viscosity | 0.05 Pa · s (50 cP) |
| Pumping Condition: | |
| Discharge amount | 1.2 $m^3$/Hr |

The drawing-out operation could be performed without any trouble for three consecutive months.

Comparative Example 1

Drawing-out operation was performed in the same manner as in Example 1 except for use of a circulation type canned motor pump having a horizontally-arranged main shaft.

A polymerization was observed in a region around bearings of the motor pump after the elapse of five days after the start of the drawing-out operation. Consequently, the drawing-out operation was forced to be suspended at that time.

EXAMPLE 2

Distilled liquid of acrylic acid having the following composition was drawn out from a distillation tower with use of a gas seal type motor pump which has a vertically-arranged main shaft, and a maximum discharge amount of 10 $m^3$/Hr, a maximum head of 50 m, and a casing made of SUS316, and manufactured by Teikoku Denki Seisakusho Kabushiki Kaisha under the below-mentioned states and condition.

| | |
|---|---|
| Composition: | |
| Acrylic acid | 5 wt. % |
| Acrylic acid dimer | 30 wt. % |
| Maleic acid | 5 wt. % |
| Other impurities | 60 wt. % |
| States: | |
| Liquid temperature | 100° C. |
| Liquid density | 1100 kg/$m^3$ |
| Liquid viscosity | 0.05 Pa · s (50 cP) |
| Pumping Condition: | |
| Discharge amount | 1.2 $m^3$/Hr |

-continued

| | |
|---|---|
| Sealing Gas: | |
| Composition | Nitrogen (100 vol. %) |
| Gas flow rate | $30 \times 10^{-6}$ $Nm^3$/min (30 Ncc/min) |

The drawing-out operation could be performed without any trouble for four consecutive months.

EXAMPLE 3

Distilled liquid of acrylic acid having the following composition was drawn out from a distillation tower with use of a gas seal type motor pump which has a vertically-arranged main shaft, and a maximum discharge amount of 10 $m^3$/Hr, a maximum head of 50 m, and a casing made of SUS316, and manufactured by Teikoku Denki Seisakusho Kabushiki Kaisha under the below-mentioned states and condition.

| | |
|---|---|
| Composition: | |
| Acrylic acid | 5 wt. % |
| Acrylic acid dimer | 30 wt. % |
| Maleic acid | 5 wt. % |
| Other impurities | 60 wt. % |
| States: | |
| Liquid temperature | 100° C. |
| Liquid density | 1100 kg/$m^3$ |
| Liquid viscosity | 0.05 Pa · s (50 cP) |
| Pumping Condition: | |
| Discharge amount | 1.2 $m^3$/Hr |
| Sealing Gas: | |
| Composition | Nitrogen (80 vol. %) Oxygen (20 vol. %) |
| Gas flow rate | $30 \times 10^{-6}$ $Nm^3$/min (30 Ncc/min) |

The drawing-out operation could be performed without any trouble for six consecutive months. No polymerization was found inside the pump.

This application is based on patent application No. 11-289324 filed in Japan, the contents of which are hereby incorporated by reference.

As this invention may be embodied in several forms without departing from the spirit of essential characteristics thereof, the present embodiment is therefore illustrative and not restrictive since the scope of the invention is defined by the appended claims rather than by the description preceding them, and all changes that fall within metes and bounds of the claims, or equivalence of such metes and bounds, are therefore intended to be embraced by the claims.

What is claimed is:

1. A method for transferring a polymerizable substance, said method comprising:

arranging a main shaft of a motor to be in a vertical direction, and mounted with an impeller for imparting a moving force to the polymerizable substance and a rotor constituting a part of the motor;

arranging the impeller to be in a position lower than the rotor;

transferring the polymerizable substance by a gas seal type motor pump provided with the motor, wherein the gas seal type motor pump is provided with a gas chamber between the impeller and the rotor, and wherein the gas chamber is filled with a gas containing molecular oxygen at 0.01 to 0.05 volumetric percent relative to a capacity of the gas seal type motor pump.

2. A method as claimed in claim 1, wherein the polymerizable substance includes at least one selected from a group consisting of a (meth)acrylic acid and a (meth)acrylic ester.

3. A method for transferring a polymerizable substance, said method comprising:

supplying the polymerizable substance to an impeller connected with a main shaft of a motor to impart a moving force to the polymerizable substance, wherein the impeller is arranged to be in a position lower than a rotor of the motor, and the main shaft is arranged to be in a vertical direction;

allowing the polymerizable substance imparted with the moving force to flow in a predetermined direction; and allowing a part of the polymerizable substance imparted with the moving force to flow into the motor through a circulation tube disposed between a discharge side of the impeller and the motor.

4. A method as claimed in claim 3, further providing the circulation tube to have a horizontal portion shorter than a vertical portion.

5. A method as claimed in claim 3, wherein the polymerizable substance includes at least one selected from a group consisting of a (meth)acrylic acid and a (meth)acrylic ester.

6. A method for transferring a polymerizable substance, said method comprising:

arranging a main shaft of a motor to be in a vertical direction, and mounted with an impeller for imparting a moving force to the polymerizable substance and a rotor constituting a part of the motor;

arranging the impeller to be in a position lower than the rotor;

transferring the polymerizable substance by a gas seal type motor pump provided with the motor, wherein the gas seal type motor pump is provided with a gas chamber between the impeller and the rotor, and wherein the gas chamber is filled with a gas containing molecular oxygen.

7. A method as claimed in claim 6, wherein the polymerizable substance includes at least one selected from a group consisting of a (meth)acrylic acid and a (meth)acrylic ester.

8. An apparatus for transferring a polymerizable substance, said apparatus comprising:

a main shaft of a motor arranged to be in a vertical direction, and mounted with an impeller for imparting a moving force to the polymerizable substance and a rotor constituting a part of said motor;

said impeller arranged to be in a position lower than said rotor; and a gas seal type motor pump provided with said motor operable to transfer the polymerizable substance, wherein said gas seal type motor pump is provided with a gas chamber between said impeller and said rotor, and wherein said gas chamber is filled with a gas containing molecular oxygen at 0.01 to 0.05 volumetric percent relative to a capacity of said gas seal type motor pump.

9. An apparatus as claimed in claim 8, wherein the polymerizable substance includes at least one selected from a group consisting of a (meth)acrylic acid and a (meth) acrylic ester.

10. An apparatus for transferring a polymerizable substance, said apparatus comprising:

a motor having a main shaft arranged in a vertical direction and mounted with an impeller to impart a moving force to the polymerizable substance, said impeller being arranged in a position lower than a rotor of said motor; and a circulation tube disposed between a discharge side of said impeller and said motor operable to allow a part of the polymerizable substance imparted with the moving force to flow into said motor;

wherein the polymerizable substance imparted with the moving force is allowed to flow in a predetermined direction.

11. An apparatus as claimed in claim 10, wherein said circulation tube has a horizontal portion which is shorter than a vertical portion.

12. An apparatus according to claim 10, wherein the polymerizable substance includes at least one selected from a group consisting of a (meth)acrylic acid and a (meth) acrylic ester.

13. An apparatus for transferring a polymerizable substance, said apparatus comprising:

a main shaft of a motor arranged to be in a vertical direction, and mounted with an impeller for imparting a moving force to the polymerizable substance and a rotor constituting a part of said motor;

said impeller arranged to be in a position lower than said rotor; and a gas seal type motor pump provided with said motor for transferring the polymerizable substance, wherein said gas seal type motor pump is provided with a gas chamber between said impeller and said rotor, and wherein said gas chamber is filled with a gas containing molecular oxygen.

14. An apparatus according to claim 13, wherein the polymerizable substance includes at least one selected from a group consisting of a (meth)acrylic acid and a (meth) acrylic ester.

* * * * *